US006439239B1

(12) United States Patent
Spatafora et al.

(10) Patent No.: US 6,439,239 B1
(45) Date of Patent: Aug. 27, 2002

(54) METHOD FOR FORMING A PACKET OF CIGARETTES

(75) Inventors: Mario Spatafora; Fabrizio Talé, both of Bologna; Franco Carini, Granarolo Emilia; Marco Ghini, S. Lazzaro Di Savena, all of (IT)

(73) Assignee: G.D Societa' Per Azioni, Bologna (IT)

( * ) Notice: Subject to any disclaimer, the term of this patent is extended or adjusted under 35 U.S.C. 154(b) by 0 days.

(21) Appl. No.: 09/522,202

(22) Filed: Mar. 9, 2000

(30) Foreign Application Priority Data

Mar. 9, 1999 (IT) ..... B099A0110

(51) Int. Cl.[7] ..... B65B 19/04; A24C 1/26
(52) U.S. Cl. ..... 131/58; 53/148; 53/444
(58) Field of Search ..... 131/283, 58; 53/148, 53/149, 150, 151, 444

(56) References Cited

U.S. PATENT DOCUMENTS 5,092,107 A * 3/1992 Lamm ..... 53/449
5,353,815 A * 10/1994 Gamberini et al. ..... 131/283

FOREIGN PATENT DOCUMENTS

EP 0 716 016 A1 12/1996

* cited by examiner

*Primary Examiner*—Christopher A. Fiorilla
(74) *Attorney, Agent, or Firm*—Marshall, Gerstein & Borun.

(57) ABSTRACT

To pack a group of cigarettes in a rigid packet, a collar, a respective inner sheet of wrapping material and a respective group of cigarettes are fed successively into a same conveying seat in which the collar and the inner sheet are at least partly folded together about the group of cigarettes as of respective flat initial configurations.

7 Claims, 4 Drawing Sheets

METHOD FOR FORMING A PACKET OF CIGARETTES

The present invention relates to a method of forming a packet of cigarettes.

In particular, the present invention relates to a method of forming a substantially rigid hinged-lid packet of cigarettes comprising a semi-rigid outer wrapping, an inner wrapping normally defined by a sheet of foil wrapped about a respective group of cigarettes, and a collar contacting the outer surface of the inner wrapping.

BACKGROUND OF THE INVENTION

In the tobacco industry, a packing machine is used comprising a pocket conveyor for feeding a succession of groups of cigarettes to a transfer wheel, which successively receives and feeds the groups to a second wheel via a station for supplying a succession of inner sheets of wrapping material, normally sheets of foil. Each inner sheet is folded into a U about a respective group as the group is transferred from the first to the second wheel, and is then further folded about the group as the group is fed forward on the second wheel. The folding of each inner sheet about the respective group of cigarettes is normally completed as the group is transferred to a third wheel on which the group, together with the fully formed inner wrapping, is fed forward and receives a respective collar which is folded into a U about the group as the group is transferred to a fourth wheel. The whole defined by the group, by the respective inner wrapping and by the respective collar is then transferred by the fourth wheel to a final packing wheel which provides for forming the outer wrapping.

European patent application EP-A1-716016 discloses a cigarette packing machine of the aforementioned type, in which the folding of a inner sheet around a respective group of cigarettes is completed on a wrapping wheel so as to obtain a fully formed inner wrapping. Then, the fully formed inner wrapping is fed to a relevant seat of a successive wrapping wheel, on which a respective collar and a respective coupon were previously fed and U-folded.

Though thoroughly tested, by being used on most currently marketed packing machines, the above succession of wheels poses several drawbacks, normally on account of the size and high cost of the packing machines as a result of the large number of wheels employed.

SUMMARY OF THE INVENTION

It is an object of the present invention to provide a packing method designed to eliminate the aforementioned drawbacks.

According to the present invention, there is provided a method of forming a packet of cigarettes as recited in claim 1.

In the method defined above, said collar, said inner sheet of wrapping material and said group of cigarettes are preferably fed to said same seat successively and in that order. According to a preferred embodiment of the method defined above, at least part of the collar and at least part of the inner sheet are folded together about the respective group of cigarettes and inside said seat.

The present invention also relates to a device for forming a packet of cigarettes.

According to the present invention, there is provided a device for forming a packet of cigarettes as recited in claim 8.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
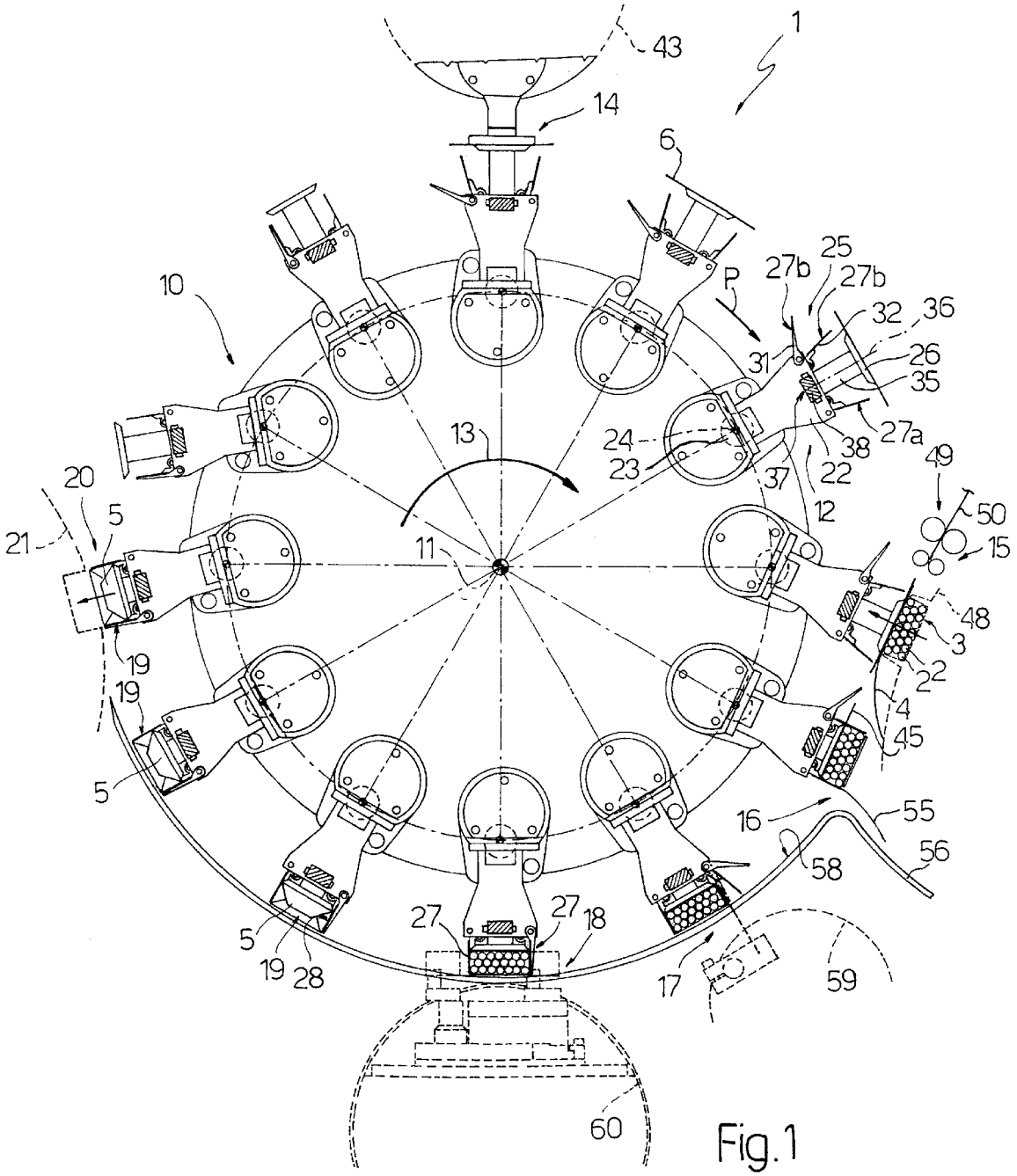
FIG. 1 shows a schematic side view, with parts removed for clarity, of a preferred embodiment of the device according to the present invention.
Figure 2:
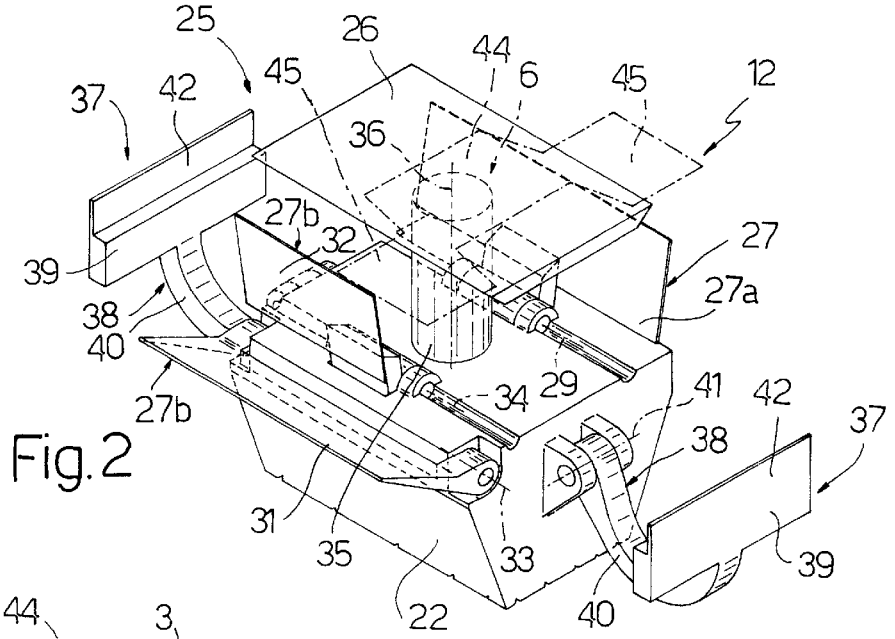
FIG. 2 shows a larger-scale view in perspective of a detail in FIG. 1.
Figure 3:
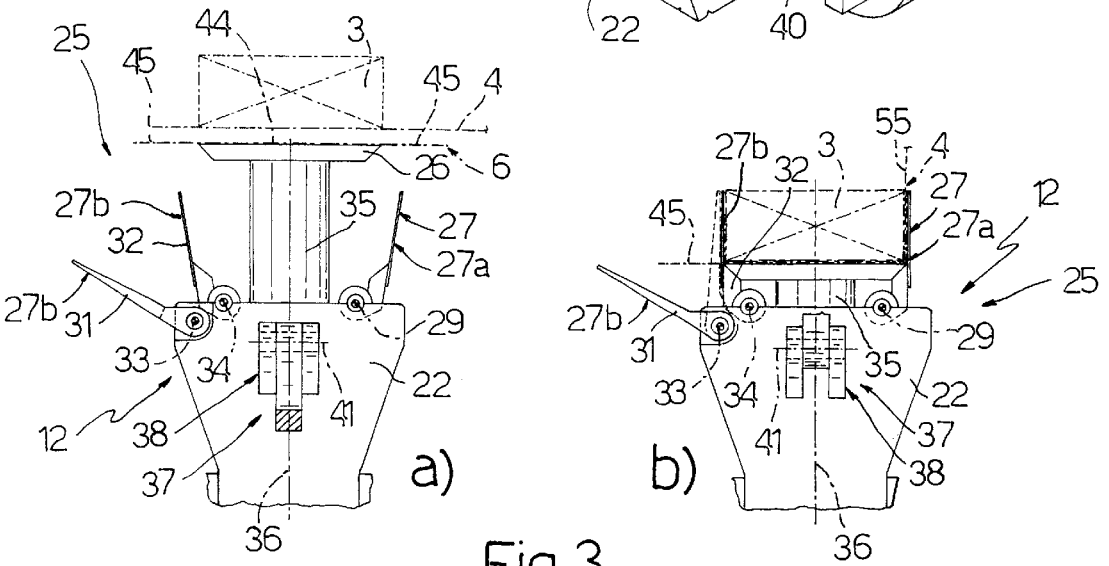
FIGS. 3*a* and 3*b* shows elevations, with parts in section and parts removed for clarity, of the FIG. 2 detail in two distinct operating positions.
Figure 4:
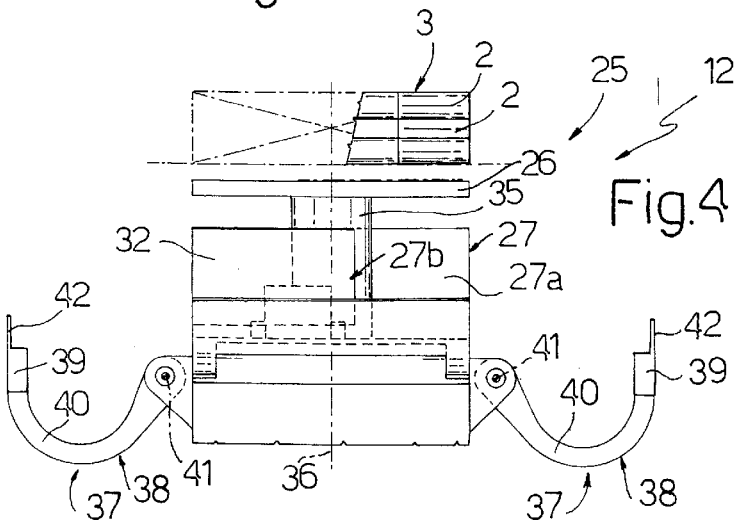
FIGS. 4 and 5 show elevations, with parts in section and parts removed for clarity, of the FIG. 2 detail in a further two distinct operating positions.
Figure 5:
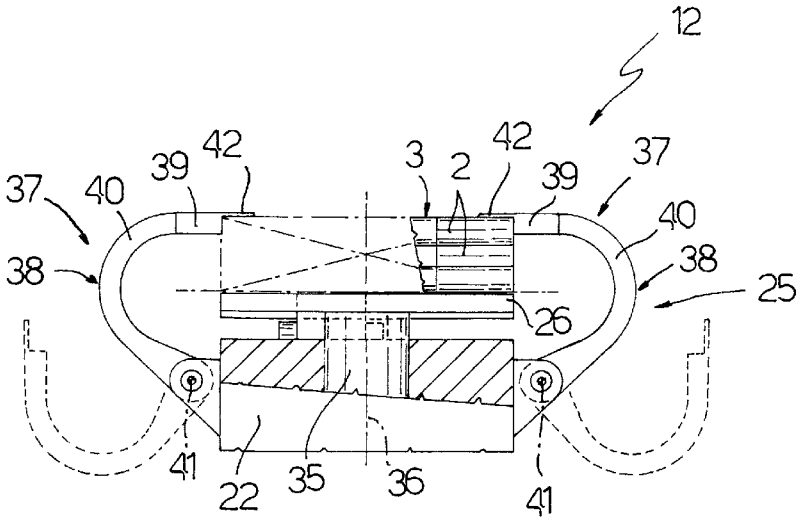
Figure 6:
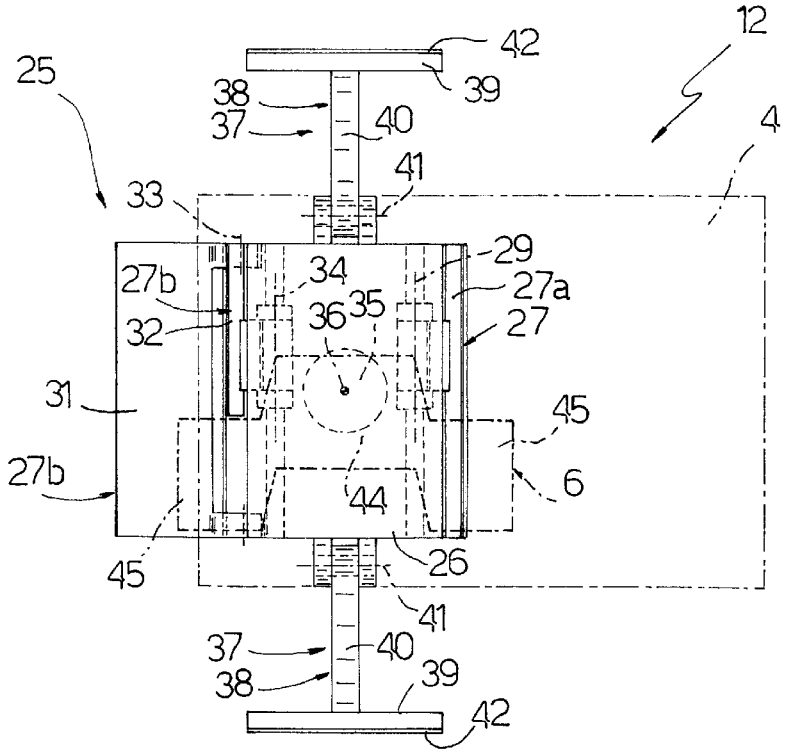
FIG. 6 shows a plan view of the FIG. 2 detail.

Number 1 in FIG. 1 indicates as a whole a device for packing cigarettes 2 in rigid hinged-lid packets (not shown).

Each rigid packet (not shown) comprises a group 3 of cigarettes 2; an inner sheet 4 of wrapping material wrapped about group 3 to form an inner wrapping 5; and a collar 6 on the outside of inner wrapping 5.

Each group 3 is substantially in the form of a parallelepipedon with a substantially rectangular section (FIGS. 7*a* and 7*b*), has a longitudinal axis 3*a* parallel to the axis of cigarettes 2, and has two parallel major lateral faces 7, two parallel minor lateral faces 8 perpendicular to faces 7, and two parallel end faces 9 perpendicular to faces 7 and 8.

Device 1 comprises a wrapping wheel 10 fitted in rotary manner to a fixed frame (not shown) and rotated, preferably continuously and by a known motor not shown, with respect to the frame (not shown) about an axis 11 perpendicular to the FIG. 1 plane.

Wheel 10 comprises a number of conveying and wrapping units 12 which are equally spaced along the periphery of wheel 10, extend radially outwards, and are fed by wheel 10 along a substantially circular path extending about axis 11 and having a portion forming a given wrapping path P.

As shown in FIG. 1, path P extends in a traveling direction 13—in the example shown, a clockwise direction—from a pickup station 14 where each unit 12 receives a respective collar 6. Along path P are also located in the following order: a supply station 15 where each unit 12 successively receives a sheet 4 of wrapping material, preferably foil, and a group 3 of cigarettes 2; a number of folding stations 16, 17, 18 where sheet 4 and collar 6 are folded about relative group 3 to form an assembly 19 defined by group 3, by respective inner wrapping 5 and by respective collar 6 folded into a U about inner wrapping 5; and a transfer station 20 where assembly 19 is transferred from respective unit 12 to a final packing wheel 21.

Each unit 12 comprises a frame 22 which extends radially outwards from the periphery of wheel 10 and is fitted, at the inner end, to a shaft 23 mounted for rotation through wheel 10 so as to oscillate, with respect to wheel 10 and by virtue of a known cam actuating device not shown, about an axis 24 parallel to axis 11.

Each unit 12 has a variable-shape pocket 25 fitted to a free end of respective frame 22 and having a concavity facing radially outwards.

Each pocket 25 comprises a bottom wall 26; and two lateral walls 27 crosswise to traveling direction 13 of wheel 10. In particular, one of walls 27 is located at the front of wall 26 in direction 13 and is hereinafter referred to as wall 27*a*, while the other is located at the rear of wall 26 in direction 13 and is hereinafter referred to as wall 27*b*.

Walls 27 of each pocket 25 are movable between a closed position in which walls 27 are substantially perpendicular to relative wall 26, and a parted position in which walls 27 diverge. In the closed position, walls 27 define a cavity 28 for housing a respective group 3 and which, for this purpose, is of a width, measured parallel to axis 11, substantially equal to the major dimensions of faces 7, and of a length, measured crosswise to axis 11, substantially equal to the minor dimensions of faces 7.

Wall 27*a* is hinged to the free end of frame 22 to move between said closed and parted positions by rotating, with respect to frame 22 and by virtue of a known actuating device not shown, about an axis 29 parallel to axis 11. Wall 27*a* is formed in one piece of a width, measured parallel to axis 11, substantially equal to the width of cavity 28, whereas wall 27*b* comprises two portions 31 and 32; portion 31 being located behind portion 32 in direction 13, and being of a width, measured parallel to axis 11, substantially equal to the width of cavity 28 and greater than the width of portion 32.

The two portions 31 and 32 are hinged to the free end of relative frame 22 to rotate individually and independently between said closed and parted positions. In particular, the two portions 31 and 32 are rotated, by respective known actuating devices (not shown) and with respect to relative frame 22, about respective axes 33 and 34 parallel to axis 29.

Wall 26 extends parallel to axis 24, is of a size substantially equal to said width and length of cavity 28, and is fitted to a shaft 35 having an axis 36 perpendicular to axis 24. Shaft 35 is connected in axially-sliding manner to frame 22, and is moved, by a known actuating device not shown, between a withdrawn position and an extracted position in which wall 26 is located outside cavity 28.

Each unit 12 also comprises a gripping device 37 which cooperates with walls 26 and 27 of respective pocket 25 to retain respective group 3 inside pocket 25.

Gripping device 37 comprises two jaws 38 located on opposite sides of shaft 35 in a direction parallel to axis 11, and each comprising a gripping head 39, and a curved rod 40 which is hinged to the free end of relative frame 22 and is oscillated—with respect to frame 22, by a known actuating device not shown, and about an axis 41 crosswise to axis 11 and substantially parallel to direction 13—to and from a gripping position gripping an end of respective group 3 against wall 26 in the withdrawn position between walls 27.

Each head 39 has a longitudinal edge 42 which extends parallel to respective axis 41, is of a width, measured parallel to axis 41, substantially equal to the minor dimension of each face 7 of group 3, and is recessed internally to assume a substantially L-shaped cross section.

In actual use, wrapping wheel 10 feeds each unit 12 to pickup station 14 so that respective pocket 25 reaches station 14 with bottom wall 26 in the extracted position, and with lateral walls 27 in the parted position.

At station 14, a known device 43 supplies pocket 25 in known manner with a collar 6 comprising a central panel 44, and two lateral wings 45 located on opposite sides of panel 44 and connected to panel 44 along respective preformed bend lines 46 extending parallel to a longitudinal axis of symmetry 47 of collar 6. Collar 6 is positioned on wall 26 in a flat initial configuration in which panel 44 and wings 45 are coplanar with one another. In this connection, it should be pointed out that collar 6 is positioned with central panel 44 contacting wall 26 and with longitudinal axis 47 crosswise to traveling direction 13, and is retained contacting wall 26 by known suction devices not shown.

At this point, unit 12 is fed towards supply station 15 in time with both a pocket conveyor 48 for supplying groups 3, and a known supply device 49 for forming a succession of sheets 4 in known manner from a continuous strip 50 and feeding sheets 4 successively to station 15 in time with respective collars 6 and respective groups 3 and in a direction substantially tangent to conveyor 48.

At station 15, bottom wall 26 is still set to the extracted position so as to support collar 6 in the flat initial configuration; lateral walls 27 are still set to the parted position; and device 49 and conveyor 48 are so positioned as to feed onto wall 26 a flat sheet 4 directly contacting collar 6, and a group 3 laid flat with a major lateral face 7 directly contacting sheet 4 and with axis 3*a* crosswise to direction 13. In particular, sheet 4 is positioned on wall 26 so that a central portion 52 of the sheet is positioned facing and substantially contacting wall 26, a relatively large portion 53 of the sheet projects frontwards, in direction 13, from wall 26, and a relatively small portion 54 of the sheet projects rearwards from wall 26.

At station 15, wall 26 in the extracted position is maintained tangent to conveyor 48 by oscillating unit 12 in controlled manner about respective axis 24.

As unit 12 travels through station 15, the combined action of a known pusher (not shown) carried by conveyor 48, and of a counter-pusher defined by wall 26 and shaft 35, provides for inserting collar 6, sheet 4 and group 3 into relative pocket 25. In this connection, it should be pointed out that, on device 1 described, collar 6, sheet 4 and group 3 are fed separately to station 15 and are inserted inside relative pocket 25 in the exact same order, i.e. collar 6 first and group 3 last.

As group 3 is transferred to relative pocket 25, wall 27*a* and portion 32 of wall 27*b* are moved into the closed position, while portion 31 of wall 27*b* remains in the parted position.

As it moves into the closed position, wall 27*a* simultaneously engages and folds both sheet 4 and collar 6 into respective L-shaped configurations about relative group 3, while portion 32, on moving into the closed position, and on account of its width and position, only engages sheet 4 which, as a result of the combined action of portion 32 and wall 27*a*, is folded into a U-shaped configuration (FIG. 7*c*) in which the two portions 53 and 54 are positioned perpendicular to portion 52, a portion 55 of portion 53 projects radially outwards of group 3, and portion 54 is confined within the thickness of group 3.

When bottom wall 26 reaches the withdrawn position, jaws 38 of respective gripping device 37 are moved into the gripping position and cooperate with wall 26, wall 27*a* and portion 32 to retain group 3 firmly inside pocket 25. In the course of which, the particular curved shape of rods 40 prevents rods 40 from interfering with the portions of sheet 4 extending outwards of wall 26 in a direction crosswise to direction 13.

As unit 12 travels through station 16, a fixed plate 56 folds portion 55 of portion 53 onto the free face 7 of group 3 (FIG. 7*d*) so that an end portion 57 of portion 55 projects rearwards from group 3. Plate 56 is coaxial with wrapping wheel 10 and defines, with wheel 10, a channel 58 along which groups 3 are fed between folding station 16 and transfer station 20.

At folding station 17, portion 32 is moved gradually into the open position to enable a known folding unit 59 to be inserted gradually between portion 32 and the corresponding face 8, and so fold portion 57 onto group 3 and partly onto portion 54 (FIG. 7*e*) to form a substantially tubular wrapping.

Figure 7:
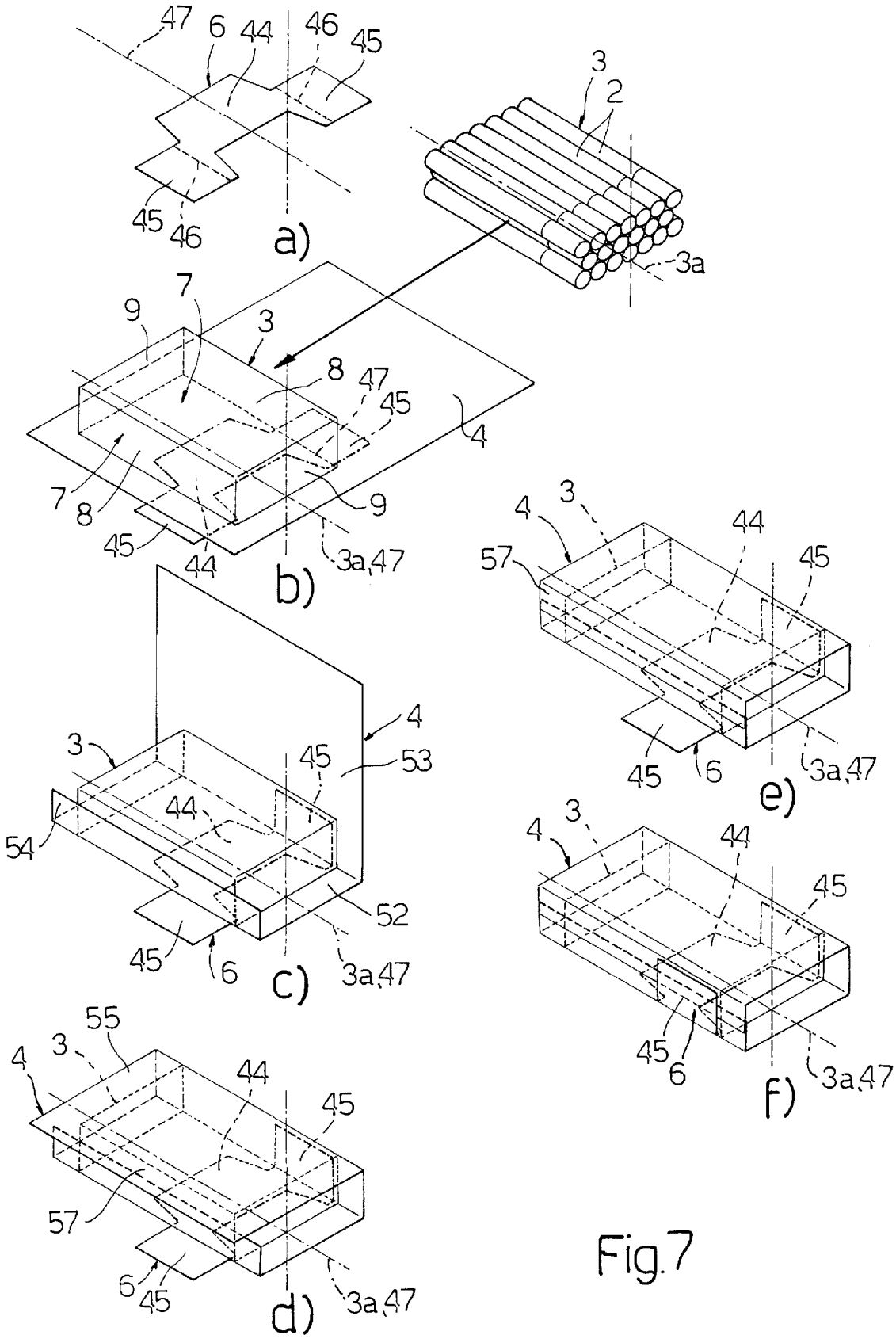
FIGS. 7*a*–7*f* shows a succession of operating steps performed by the FIG. 1 device.

At this point, after portion 32 is restored to the closed position, portion 31 of wall 27*b* of pocket 25 is also moved into the closed position to engage and fold relative lateral wing 45 of collar 6 squarely, with respect to central panel 44, onto respective face 8 of group 3 and on the outside of sheet 4 (FIG. 7*f*).

Next, at folding station 18, jaws 38 are moved into an open position, and a known folding unit 60 closes the ends of inner wrapping 5 to complete the formation of assembly 19.

Finally, at transfer station 20 at the outlet of channel 58, assembly 19 is transferred in known manner (not shown) to packing wheel 21.

What is claimed is:

1. A method of forming a packet of cigarettes; the packet comprising a group of cigarettes, an inner sheet of wrapping material wrapped about said group to form an inner wrapping, and a collar on the outside of said inner wrapping; the method comprising:

the step of feeding the collar, the inner sheet and the group individually to a same seat on a same wrapping conveyor; the collar and the inner sheet being fed individually to said seat in respective flat initial configurations; and a first folding step for folding said collar and said inner sheet of wrapping material, inside said seat, so as to simultaneously assume respective L-shaped configurations about the relative group as of said respective flat initial configurations.

2. A method as claimed in claim 1, further comprising feeding said collar, said inner sheet of wrapping material and said group to said same seat successively and in that order.

3. A method as claimed in claim 1, further comprising folding the collar and the inner sheet at least partly about the group and inside said seat as of respective flat initial configurations.

4. A method as claimed in claim 1, further comprising folding at least part of the collar and at least part of the inner sheet together about the respective group and inside said seat.

5. A method as claimed in claim 1, further comprising a second folding step for folding said inner sheet of wrapping material about said group, as of the respective said L-shaped configuration and inside said seat, to form a substantially tubular wrapping about the relative said group; said collar remaining in the respective said L-shaped configuration in the course of said second folding step.

6. A method as claimed in claim 5, further comprising a third folding step for folding said collar into a U shape about said tubular wrapping inside said seat and as of the respective said L-shaped configuration.

7. A method of forming a packet of cigarettes, the packet comprising a group of cigarettes, an inner sheet of wrapping material wrapped about said group to form an inner wrapping, and a collar on the outside of said inner wrapping, the method comprising:

the step of feeding the collar, the inner sheet and the group individually to a same seat on a same wrapping conveyor; the collar and the inner sheet being fed individually to said seat in respective flat initial configurations; and at least part of the collar and at least part of the inner sheet are folded together about the respective group and inside said seat.

* * * * *